United States Patent [19]

Vann et al.

[11] 4,299,287

[45] Nov. 10, 1981

[54] BAR ACTUATED VENT ASSEMBLY AND PERFORATING GUN

[75] Inventors: Roy R. Vann; George W. Ribble; Flint R. George, all of Houston, Tex.

[73] Assignee: Geo Vann, Inc., Houston, Tex.

[21] Appl. No.: 151,148

[22] Filed: May 19, 1980

[51] Int. Cl.[3] ..... E21B 33/14; E21B 43/116; E21B 43/26

[52] U.S. Cl. ..... 166/297; 166/55.1; 166/318; 175/4.56

[58] Field of Search ..... 166/55, 55.1, 63, 297, 166/299, 315, 318; 175/2, 4.52, 4.56

[56] References Cited

U.S. PATENT DOCUMENTS

| | | | |
|---|---|---|---|
| 2,601,122 | 6/1952 | McKinley | 166/55.1 X |
| 2,633,916 | 4/1953 | Baker et al. | 166/318 X |
| 3,001,584 | 9/1961 | Scott | 166/63 |
| 3,189,094 | 6/1965 | Hyde | 166/63 X |
| 3,527,297 | 9/1970 | Todd | 166/318 X |
| 3,706,344 | 12/1972 | Vann | 166/55 X |
| 3,871,448 | 3/1975 | Vann | 166/133 X |
| 3,990,507 | 11/1976 | Vann | 166/55.1 |
| 4,009,757 | 3/1977 | Vann | 175/4.56 X |
| 4,194,577 | 3/1980 | Vann | 166/297 X |

*Primary Examiner*—James A. Leppink

*Assistant Examiner*—George A. Suchfield

*Attorney, Agent, or Firm*—Marcus L. Bates

[57] ABSTRACT

A casing gun is suspended downhole adjacent to a hydrocarbon containing formation by attaching the gun to the end of a tubing string. A packer device isolates the lower downhole casing annulus from the upper casing annulus. The casing gun has a firing head located at the upper end thereof which is actuated in response to impact. A vent assembly underlies the packer and is connected in series relationship respective to the gun firing head and the packer. A specially constructed bar device is dropped into a lubricator at the wellhead and travels down the interior of the tubing string, where the bar impacts against a sliding sleeve of the vent assembly, thereby moving the sleeve and opening a port which communicates the interior of the tubing string with the lower casing annulus. The bar continues to travel downhole until it impacts against the firing head, thereby detonating the perforating gun. Hence, the present invention comprehends the provision of a special weight which is dropped downhole to sequentially impact against a novel vent assembly and against a perforating gun head in rapid succession, so that a hydrocarbon containing formation can be completed in an unusual manner.

11 Claims, 5 Drawing Figures

BAR ACTUATED VENT ASSEMBLY AND PERFORATING GUN

BACKGROUND OF THE INVENTION

In my previous U.S. Pat. No. 3,706,344, there is set forth a method of completing hydrocarbon producing formations so that optimum conditions prevail during the perforation of the casing. In particular, it has been found desirable for a well casing to be perforated in a manner which provides a minimum of back pressure against the newly perforated formation, so that the formation pressure differential is utilized to its fullest extent in order to expel any foreign material therefrom, thereby avoiding contamination of the sensitive formation. Moreover, when the formation is allowed to expend all of its energy towards the initial flow, the perforations are cleaned and enlarged to the maximum attainable value which can ever be achieved during the life of the borehole.

In my previous U.S. Pat. Nos. 3,706,344 and 4,009,757, there is set forth a perforating gun having a gun firing head thereon which is responsive to impact. In my U.S. Pat. Nos. 3,871,448 and 3,931,855, there is set forth a vent assembly which is opened in response to the setting of a packer.

The combination of either of the first two recited patents with either of the second recited two patents enable a formation to be completed in the above recited desired manner. However, in carrying out this well completion task, it is necessary to have equipment on hand which enables manipulation of the packer by movement of the tubing string. Equipment of this type is expensive.

It would therefore be desirable to be able to set a packer, and to leave a casing gun downhole in an isolated condition until some subsequent time when it is more convenient to complete the well. It would also be desirable if the well could be completed by opening a vent string and immediately thereafter perforating the hydrocarbon containing formation. Apparatus and method for achieving these desirable and unique goals is the subject of the present invention.

SUMMARY OF THE INVENTION

This invention comprehends both method and apparatus for completing a hydrocarbon producing formation in a manner which permits the formation to flow unobstructed into a tubing string and uphole into the ambient at the instant the perforations are formed in the casing. This method is achieved by isolating a perforating gun downhole adjacent to the formation, and dividing the casing annulus into a lower and upper annulus by the provision of a packer, thereby obtaining absolute control over the well. A vent assembly, made in accordance with the present invention, underlies the packer and includes a port formed therein which communicates the tubing interior with the lower annulus. The port is closed by a sliding sleeve assembly.

The casing gun includes a firing head responsive to impact. A weighted bar is dropped down through the tubing string where it falls downhole towards the perforating gun. The bar includes means thereon for engaging and moving the sliding sleeve so that the port of the vent assembly is opened, thereby communicating the lower annulus with the interior of the tubing string.

The bar continues to fall downhole until it subsequently impacts against the gun firing head, thereby detonating the shaped charges and perforating the casing so that the hydrocarbon containing formation is opened to the ambient by means of the lower annulus, the vent assembly, and the tubing string. Therefore, the bar which is dropped down through the tubing string is made special to sequentially perform these two operations in rapid succession, that is, the bar opens the vent assembly and, immediately thereafter, fires the casing gun, all in response to impact resulting from gravitational forces.

The primary object of the present invention is the provision of method and apparatus for completing a hydrocarbon containing formation located downhole in a cased borehole.

Another object of the present invention is the provision of apparatus and method for utilizing kinetic energy of an object falling downhole in order to sequentially open a vent assembly and detonate a perforating gun so that an isolated hydrocarbon containing formation is communicated with ambient in a very small time interval.

A still further object of this invention is the provision of a sliding vent assembly having an axial bore which receives a marginal length of a bar apparatus, so that the vent assembly is moved to the opened position, while the bar continues to fall down the hole and impacts against a gun firing head to thereby detonate the shaped charges of a casing gun, whereupon, flow from a production formation is immediately effected through the new perforations, up the lower annulus, into the vent assembly, and up the tubing string to ambient so that the well is immediately cleaned up and contamination of the formation is avoided.

These and various other objects and advantages of the invention will become readily apparent to those skilled in the art upon reading the following detailed description and claims and by referring to the accompanying drawings.

The above objects are attained in accordance with the present invention by the provision of a method for use with apparatus fabricated in a manner substantially as described in the above abstract and summary.

DETAILED DESCRIPTION OF THE PREFERRED EMBODIMENT

Figure 1:
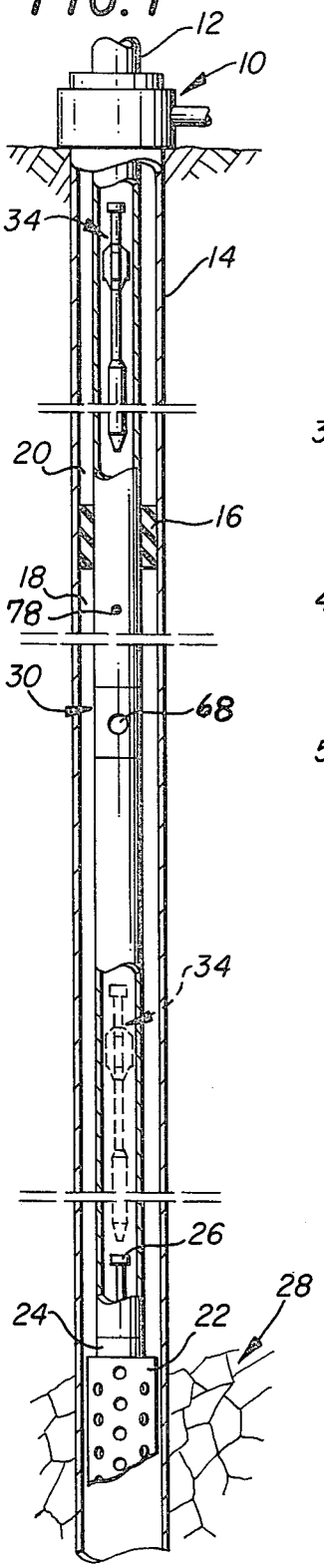
FIG. 1 is a hypothetical, cross-sectional view of a borehole having apparatus made in accordance with the present invention disclosed in conjunction therewith.
Figure 2:
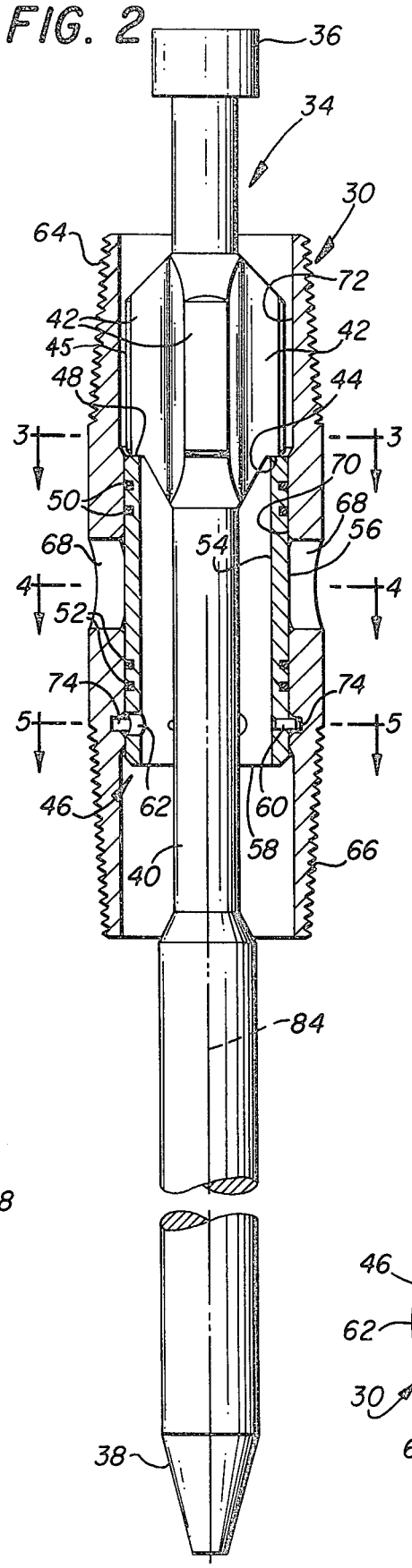
FIG. 2 is an enlarged, part cross-sectional view of part of the apparatus disclosed in FIG. 1; and, FIGS. 3, 4, and 5, respectively, are cross-sectional views taken along line 3—3, 4—4, and 5—5, respectively, of FIG. 2.
Figure 3:
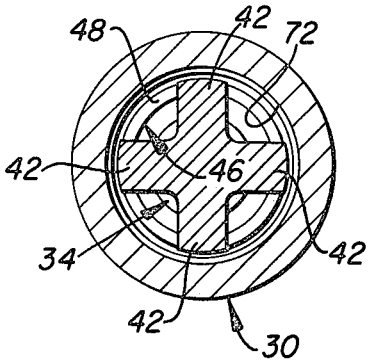
Figure 4:
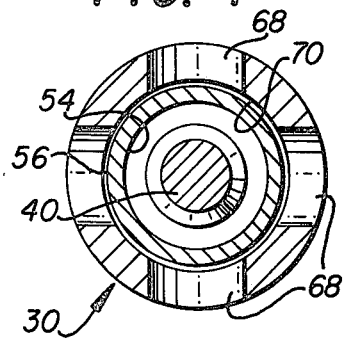
Figure 5:
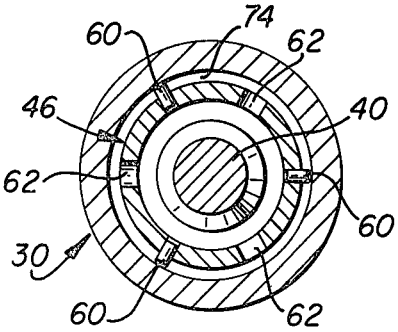

In FIG. 1, there is disclosed a wellhead 10 having a tubing string 12 which extends downhole through a casing 14. A packer apparatus 16, which can take on any number of different forms, divides the casing annulus into a lower and upper annulus 18 and 20, respectively. A casing gun 22 has a firing head 24 actuated by a trigger apparatus 26, such as set forth in U.S. Pat. Nos. 3,706,344 and 4,009,757.

A hydrocarbon containing formation 28 is separated from the lower annulus by the unperforated casing, and by the usual cement which surrounds the casing. An impact responsive vent assembly 30, made in accordance with this invention, underlies the packer and includes a port 68 formed therein which is normally in the closed position. The port, when opened, communicates the lower annulus with the tubing interior.

A bar device 34, made in accordance with this invention, is of a size to be dropped through the lubricator and down through the tubing string. The bar device 34 functions as a combination sleeve actuator and gun actuator because, as the bar falls through the vent assembly 30, the port 68 thereof is opened, thereby communicating the lower annulus with the interior of the tubing string. As the bar 34 continues to fall downhole, it subsequently strikes the trigger apparatus of the firing head, thereby detonating the shaped charges of the gun which perforate the casing, with the newly formed perforations extending back up into the hydrocarbon containing formation, to thereby enable formation fluid to be produced.

This sequence of events provides a flow path for the hydrocarbons which flow from the formation, through the perforations, into the lower annulus, up the lower annulus, and through port 68 into the tubing, up the tubing string, and out into the ambient. Therefore, the maximum or greatest initial flow which can ever be attained by the formation is thereby experienced at the moment of perforation, and accordingly, debris or foreign matter which may otherwise contaminate the formation are forced to flow out of the wellbore; and, at the same time, the deep penetrations leading back up into the formation are cleaned and enlarged because the maximum available pressure drop has been effected across the formation and is utilized to bring about this cleaning operation. There never again will be an opportunity to effect a surging condition such as described herein during the life of this particular hydrocarbon bearing formation.

In FIGS. 2–5, it will be noted that the bar 34 is provided with a fishing neck 36 at the upper end thereof and a leading end 38 at the other, or lower, end thereof. The leading end is streamlined and functions to abuttingly engage the trigger apparatus of the gun firing head. The bar includes a lower neck 40 which supports a plurality of radially spaced guide members 42. The leading edge of each of the guide members is in the form of a shoulder 44. The guide members extend radially outwardly and terminate at a longitudinal edge 45 in spaced relationship respective to the minimum inside diameter of the entire interior of the tubing string, save the inside diameter of the illustrated sliding sleeve 46.

The slidable vent sleeve 46 is provided with a circumferentially extending upper edge portion 48 which is positioned to abuttingly engage the shoulder 44 located on the guide members 42.

Spaced pairs of o-rings 50 and 52 are placed in the illustrated circumferentially extending o-ring grooves. An axial passageway 54 of a diameter less than the effective diameter of the guide members extends through the vent sleeve. The vent sleeve has an outer cylindrical surface 56 of constant diameter which terminates at lower circumferentially extending edge 58. Radially spaced shear pins 60 alternate with ports 62. The shear pins fix the sleeve in captured relationship within the main body of the vent assembly, so that a predetermined downward force must be placed on the sliding sleeve before movement thereof is achieved.

The main body of the vent assembly is threaded at 64 and 66 for enabling making up and breaking out of the vent assembly respective to the tubing string. Ports 68 are radially spaced about the main body. The interior of the main body is provided with an axial bore having a small constant diameter 70 which enlarges at each marginal end into a larger bore 72. The larger bore is equal to the inside diameter of the tubing string, so there is no possibility of the sliding sleeve failing to travel downhole towards the gun.

A circumferentially extending groove 74 extends 360° about the interior of the main body for receiving the shear pins 60 in captured relationship therewithin.

As a second embodiment of the invention, it is sometime advantageous to employ a frangible hollow plug 78, such as a commercially available Kobe knockout plug, at a location uphole of the main body of the vent assembly and downhole of the packer device. The leading end of the falling bar contacts and breaks the plug, thereby communicating the interior of the tubing string with the lower annulus through a small bleed port formed within the knockout plug. The kinetic energy required for breaking the plug is insignificant compared to the stored energy of the traveling bar 34 as the leading end 38 destroys the plug. The residual energy is expended in shearing the pin 60 and moving the sliding sleeve in a downhole direction. The plug is threaded in the usual manner and includes a free end which extends into proximity of the axial centerline 84 of the vent assembly.

There are instances where the pressure differential between the interior of the tubing string and the lower annulus occasionally prevents movement of a sliding sleeve assembly. In such an instance, should the traveling bar be arrested, the pins 60 nevertheless will shear, bleed down through the broken plug will occur, and gravity will cause the weight of the bar to move the sliding sleeve to the opened position as soon as the differential in pressure across the sleeve has been sufficiently reduced, or equalized. The bar will again accelerate and subsequently impact against the trigger apparatus of the gun firing head, thereby detonating the charges of the gun.

In most instances, however, the bar will continue traveling as it strikes the plug, and thereafter opening the sliding sleeve, whereupon the bar continues downhole to subsequently strike the gun firing head detonation apparatus so that the traveling bar sequentially opens the vent assembly and fires the casing gun in a very small time interval.

I claim:

1. In a cased wellbore having a perforating gun suspended adjacent to a hydrocarbon containing formation by a tubing string, the gun having a firing head actuated by impact, a packer which divides the casing annulus into an upper and a lower annulus, and a vent assembly underlying the packer and connected in series relationship within the tubing string, the improvement comprising:

said vent assembly includes a main body having an axial passageway formed therethrough, a port formed into said main body which communicates the lower annulus with the tubing interior, a sleeve slidably received within said axial passageway and closing said port against flow;

a bar having a longitudinally disposed body which can be received in axially aligned relationship within the tubing string, a leading end of the bar being of a configuration to impact against the gun firing head, means on said bar for engaging and moving said sleeve in a downhole direction to an open port position;

so that the bar can be dropped down through the tubing string, whereupon the bar engages and moves the sleeve to the opened position, and continues to travel downhole where the bar impacts against the gun firing head to detonate the shaped charges of the gun and perforate the casing, whereupon flow immediately commences from the hydrocarbon containing formation, and flows through the perforations, up the lower annulus, and into the port of the vent assembly, up the tubing string, and to the wellhead, where the produced hydrocarbons can be gathered.

2. The improvement of claim 1, and further including a knockout plug positioned above said sliding sleeve, said knockout plug being located in said tubing string and made of frangible material so that the traveling bar breaks the plug, thereby communicating the interior of the tubing string with the lower annulus, so that the sliding sleeve can be moved downhole to uncover the port.

3. The improvement of claim 1 wherein said sliding sleeve is fixed to the main body of the vent assembly by a shear pin, and circumferentially extending seals are positioned between the interior of the main body and the exterior of the sliding sleeve and seals said port to prevent flow from occurring between the interior of the tubing string and the lower casing annulus.

4. The improvement of claim 1 wherein said bar includes a lower end adapted to impact against the gun firing head, and a plurality of radially spaced apart fins having a maximum diameter which is smaller than the minimum diameter of the tubing;

said fins have a leading edge which terminate in a shoulder, with the shoulder being of a configuration to jointly engage the upper edge portion of the sliding sleeve.

5. In a cased wellbore having a perforating gun suspended on the end of a tubing string, said gun being located adjacent to a hydrocarbon containing formation; said gun having a firing head which is actuated by impact, a packer device which divides the casing annulus into an upper and a lower annulus; the combination with said packer and perforating gun of a vent assembly and a traveling bar;

said vent assembly being located in underlying relationship respective to the packer, and connected in series relationship respective to the tubing string; said vent assembly includes a main body having a port formed therein; a sliding sleeve covering said port and preventing flow therethrough, means on said traveling bar for engaging and moving said sliding sleeve in a downhole direction, means on said bar for impacting against said gun firing head;

whereby, said bar can be dropped down through the tubing string where it sequentially engages and moves the sliding sleeve to open the port and subsequently impacts against the gun firing head to detonate the gun and cause the casing to be perforated, whereupon hydrocarbons flow from the formation, through the perforations, up through the lower annulus, through the opened port, into the tubing string, and uphole to the top of the wellbore.

6. The combination of claim 5 wherein said sliding sleeve is fixed to the main body of the vent assembly by a shear pin, and circumferentially extending seals are positioned between the interior of the main body and the exterior of the sliding sleeve and seals said port to prevent flow from occurring between the interior of the tubing string and the lower casing annulus.

7. The combination of claim 5 wherein said bar includes a lower end adapted to impact against the gun firing head, and a plurality of radially spaced apart fins having a maximum diameter which is smaller than the minimum diameter of the tubing;

said fins have a leading edge which terminate in a shoulder, with the shoulder being of a configuration to jointly engage the upper edge portion of the sliding sleeve.

8. The combination of claim 5 wherein a knockout plug is positioned above said sliding sleeve, said knockout plug being located in said tubing string and made of frangible material so that the traveling bar breaks the plug, thereby communicating the interior of the tubing string with the lower annulus, so that the pressure across the sliding sleeve can be equalized.

9. A method of completing a hydrocarbon containing formation located downhole in a cased borehole, comprising:

running a casing gun downhole into proximity of the formation, providing the gun with a firing head responsive to impact;

dividing the casing annulus into a lower and upper annulus by a packer device;

positioning a vent assembly in series relationship respective to the tubing string, and locating the vent assembly below said packer device;

forming a port through the vent assembly; and, closing the port with a sliding sleeve assembly;

dropping a traveling bar down the tubing string and using the momentum of the bar for moving the sliding sleeve downhole to open the port, and subsequently using the momentum of the traveling bar for detonating the firing head, so that the casing gun perforates the casing produced fluid flows from the hydrocarbon containing formation, into the lower casing annulus, uphole into the opened port of the vent assembly, into the tubing string, up the tubing string to the surface of the ground, thereby completing the wellbore.

10. The method of claim 9 wherein the sliding sleeve has an upper edge formed thereon and the bar has a shoulder formed thereon, and the momentum of the bar impacts the bar shoulder against the sliding sleeve to force the sleeve to move so that the port is uncovered.

11. The method of claim 10 wherein the pressure between the lower annulus and the interior of the tubing is equalized prior to the detonation of the gun by placing a knockout plug above the vent assembly and below the packer device;

and, breaking the plug with the bar so that the lower annulus and tubing interior are communicated with one another.

* * * * *